US007690628B2

(12) United States Patent
Hewitt et al.

(10) Patent No.: US 7,690,628 B2
(45) Date of Patent: Apr. 6, 2010

(54) FENCE FASTENER

(76) Inventors: Craig Hewitt, Box 628, Hythe, Alberta (CA) T0H 2C0; Lori Hewitt, Box 628, Hythe (CA) T0H 2C0

( * ) Notice: Subject to any disclaimer, the term of this patent is extended or adjusted under 35 U.S.C. 154(b) by 0 days.

(21) Appl. No.: 11/953,451

(22) Filed: Dec. 10, 2007

(65) Prior Publication Data

US 2009/0146123 A1 Jun. 11, 2009

(51) Int. Cl.
*E04H 17/10* (2006.01)

(52) U.S. Cl. ..... 256/54; 24/21; 24/20 R; 256/47

(58) Field of Classification Search ..... 256/24, 256/45, 47, 50, 54, 12.5, 49; 24/20 R, 21.23 R; 285/419
See application file for complete search history.

(56) References Cited

U.S. PATENT DOCUMENTS

| | | | | |
|---|---|---|---|---|
| 1,267,238 | A | 5/1918 | Love | |
| 2,887,233 | A * | 5/1959 | Shield | 403/217 |
| 2,887,333 | A | 5/1959 | Shield | |
| 3,023,036 | A | 2/1962 | Taylor, Jr. | |
| 3,347,527 | A * | 10/1967 | Andrews | 256/12.5 |
| 3,526,934 | A * | 9/1970 | Owen, Sr. | 285/154.1 |
| 3,604,686 | A * | 9/1971 | Parisien | 256/32 |
| 3,930,637 | A * | 1/1976 | Davis | 256/32 |
| 4,062,523 | A * | 12/1977 | Nowatzki et al. | 256/47 |
| 4,191,361 | A * | 3/1980 | Jensen | 256/12.5 |
| 4,576,364 | A * | 3/1986 | O'Fearna | 256/24 |
| 4,667,702 | A * | 5/1987 | Roth | 138/162 |
| 4,742,600 | A * | 5/1988 | Calmettes et al. | 24/20 R |
| 4,883,257 | A * | 11/1989 | Bracken | 256/54 |
| 4,910,933 | A * | 3/1990 | Schwarzfeller et al. | 256/47 |
| 4,951,716 | A * | 8/1990 | Tsunoda et al. | 138/162 |
| 5,066,050 | A * | 11/1991 | Kretchman | 285/319 |
| 5,409,196 | A * | 4/1995 | Specht | 256/54 |
| 5,660,377 | A | 8/1997 | Specht | |
| 5,660,505 | A | 8/1997 | Emory, III | |
| 5,758,868 | A | 6/1998 | Shea | |
| 6,010,116 | A * | 1/2000 | Knott, Sr. | 256/47 |
| 6,113,076 | A * | 9/2000 | Hancock-Bogese et al. | 256/1 |
| 6,206,347 | B1 * | 3/2001 | Kelley | 256/47 |
| 6,260,829 | B1 | 7/2001 | Anderson et al. | |
| 6,481,926 | B2 | 11/2002 | Benedict et al. | |
| 6,558,075 | B2 * | 5/2003 | Benedict et al. | 405/21 |
| 6,595,473 | B2 * | 7/2003 | Aoki et al. | 248/74.4 |

(Continued)

*Primary Examiner*—Michael P Ferguson
*Assistant Examiner*—Joshua T Kennedy
(74) *Attorney, Agent, or Firm*—Maxey Law Offices, PLLC; Stephen Lewellyn

(57) ABSTRACT

A fastener for anchoring fencing to a post. The fastener includes first and second separable and complementary sections, each section have an inner and outer surface, a middle web portion, opposed first and second sides extend from opposite edges of the middle web portion in a direction outwardly from the middle web portion, and opposed first and second ends. Male coupling members extend in a direction outward from one of the sides of the first section and the second section has female receiving spaces on one of the sided. Wherein the male coupling members being biasable for engagement with the spaces to detachably secure the sections together with the inner surfaces facing one another such that the inner surfaces define an axial passage that extends from the first to the second ends of the sections, whereby the passage permits the fencing and post to be clamped together between the sections.

4 Claims, 4 Drawing Sheets

U.S. PATENT DOCUMENTS 6,722,817 B2 * 4/2004 Benedict et al. ..... 405/21
6,893,007 B2 * 5/2005 Asenbauer ..... 256/47
7,234,688 B1 * 6/2007 Asenbauer ..... 256/26
2004/0217340 A1 * 11/2004 Bergdoll ..... 256/32
2005/0116213 A1 6/2005 Dahowski et al.
2005/0199865 A1 9/2005 Wink
2006/0226406 A1 * 10/2006 Vise et al. ..... 256/19

* cited by examiner

FENCE FASTENER

BACKGROUND OF THE INVENTION

1. Field of the Invention

The present invention relates generally to fasteners for attaching fencing to fence posts, and more particularly, relating to a reusable fastener for removably attaching fencing to fence posts.

2. Discussion of Related Art

Safety or barrier fencing, among other uses, is widely used along roadways to stop drifting of debris onto the roadways, and to restrict entry to open pits, trenches, construction sites, or other restricted areas.

A traditional method of securing safety fencing to a fence post is by using plastic tie straps or small pieces of wire tied along the length of the post at spaced apart locations. There are many drawbacks to this method, including being very time consuming, requires the use of a tool to twist the wire, is difficult to accomplish with gloves on, and it is not very environmentally friendly since most of these materials are not reusable, and in most cases the wire or straps are left on the ground after being remove. Further, this method also tends to damage the safety fencing as a result of the wire or straps cutting into the fencing material, which can lead to the fencing breaking loose, this is particularly the case when the safety fencing is subjected to strong winds.

Accordingly, there is a need for a fence fastener with an improved construction that is capable of securing fencing to fence posts quickly and easy without the use of tools, that requires less time for installing and removing the fastener, that is environmentally friendly, and that is not damaging to the fencing.

SUMMARY OF THE INVENTION

To overcome the problems discussed above and other disadvantages inherent in the known types of fence fasteners the preferred embodiments of the present invention provide a fastener that will save time with a simple snap together of a first and second half section thus reducing the time in labor spent installing and removing the fence, thus reducing the cost, and it is not as cumbersome as tying wire or straps on the post in different locations. The preferred embodiments of the present invention also provide a reusable fastener that can withstand the harsh elements and leaves no unenvironmentally friendly debris behind after removing the fasteners. The preferred embodiments of the present invention further provide a fastener that clamps a larger area of the fencing to the fence post without requiring stretching of the fence, thus making it much harder for the fencing to be ripped free from the post, due to the elements.

To achieve these and other advantages, in general, in one aspect, a fastener for anchoring fencing to a fence post is provided. The fastener includes first and second separable and complementary sections, the first and second sections each have an inner surface, an outer surface, a middle web portion, opposed first and second sides extend from opposite edges of the middle web portion in a direction outwardly from the middle web portion, and opposed first and second ends. One or more male coupling members extend in a direction outward from one of the first and said second sides of the first section. One or more female receiving spaces on one of the first and said second sides of the second section. Wherein the one or more male coupling members being biasable for releasable engagement with the one or more female receiving spaces to detachably secure the first and the second sections together with the inner surfaces facing one another such that the inner surfaces define an axial passage that extends from the first end to the second end of each of the first and said second sections, and wherein the passage permits a section of fencing and a fence post to be clamped together between the first and said second sections.

In general, in another aspect, the one or more female receiving spaces is a through hole defined by one of said first and said second sides of said second section.

In general, in another aspect, each of the one or more male coupling members is dimensioned to fit through an opening in the section of fencing.

In general, in another aspect, one or more male coupling members of the first and the second sides of the first section are laterally biasable.

In general, in another aspect, the first section further includes one or more female receiving spaces formed on one of the first and the second side of the first section, and the second section includes one or more male coupling members extending in a direction outward from one of the first and the second side of the second section.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Reference will now be made in detail to the preferred embodiments of the present invention, examples of which are illustrated in the accompanying drawings.

Figure 1:
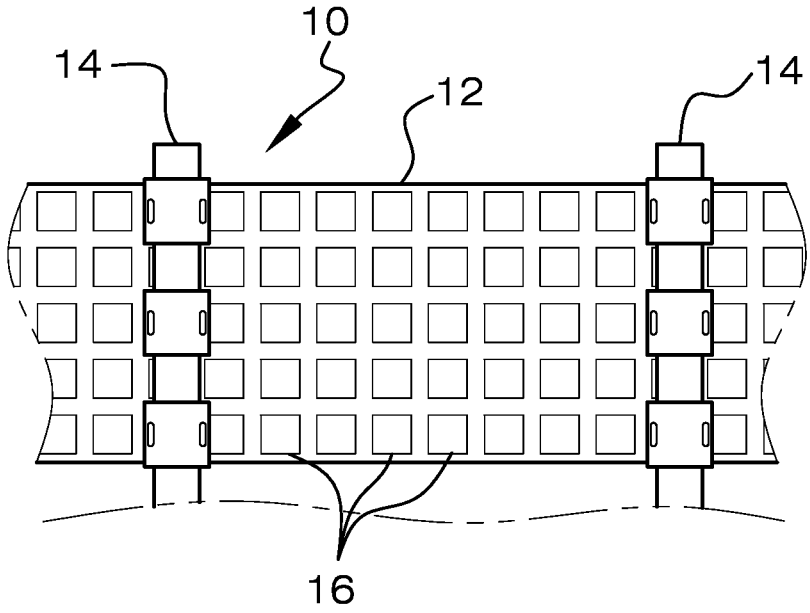
FIG. 1 is a diagrammatic in use view of a plurality of fence fasteners constructed in accordance with the principles of the present invention, shown securing a fence to a fence post.

Referring now to the drawings, reference numeral 10 generally designates a fence fastener of the present invention for quickly, and removably attaching fencing to fence posts. With particular reference to FIG. 1, there is shown, a partial in use view of a section of fencing 12 attached to a fence post 14 by a plurality of the fence fasteners 10, which are attached at spaced vertical locations along the fencing and fence post. The fencing 14 is clamped to the fence post 14 by the fasteners 10.

The fencing 12 may be typical safety or barrier fencing of an open mesh construction having openings 16. The fencing is typically supplied in rolls and of various widths and lengths. While the fencing 12, as shown, is a flexible fencing of the safety or barrier type, any fencing having holes or open spaces may be secured by one or more of the fasteners 10

Figure 2:
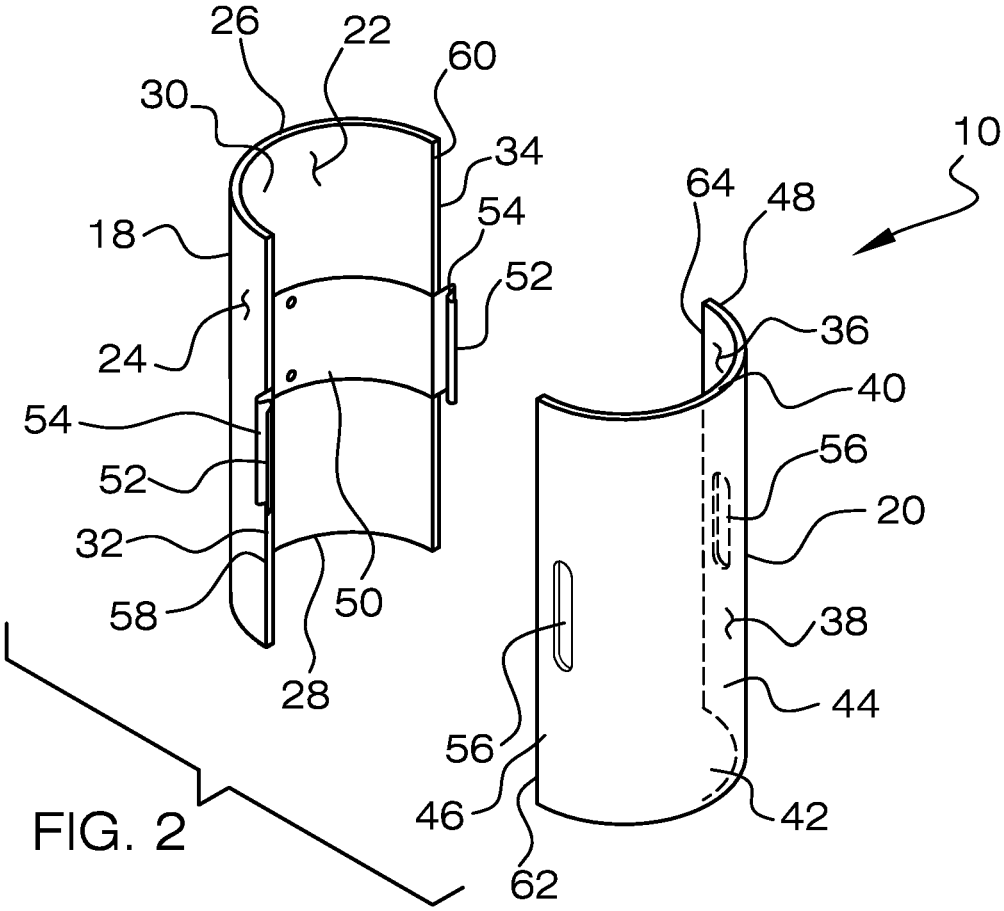
FIG. 2, is a perspective exploded view of a fence fastener constructed in accordance with the principles of the present invention.

With reference now to FIG. 2, there is shown, a single fastener 10 in an exploded configuration. The fastener 10 includes first and second separable and complementary sections 18 and 20. The first section 18 includes an inner surface 22, an outer surface 24, opposed first and second longitudinally spaced ends 26 and 28, a middle web portion 30 extending between ends 26 and 28, and opposed first and second laterally spaced and parallel sides 32 and 34. Sides 32 and 34 extend in a direction outwardly from the middle web portion 30 and terminate at edges 58 and 60 respectively.

Likewise, the second section 20 includes an inner surface 36, an outer surface 38, opposed first and second longitudinally spaced ends 40 and 42, a middle web portion 44 extending between ends 40 and 42, and opposed first and second laterally spaced and parallel sides 46 and 48. Sides 46 and 48 extend in a direction outwardly from the middle web portion 44 and terminate at edges 62 and 64 respectively.

The first and second sections 18 and 20 each have a generally semi-circular shape in the horizontal or lateral cross-section, and once connected form a generally circular shape in the horizontal or lateral cross-section. The sections 18 and 20 being generally curved and when connected together are free of edges that can be easily caught on clothing, or other objects that may come into contact with the fastener 10 preventing inadvertent separation of the sections and freeing of fencing from a fence post. While the first and second section 18 and 20 are shown and described to have a similar shape, the first and second sections may be asymmetrical.

The first and second sections 18 and 20 are securely, but removably coupled together by a fastening system that may include one or more male coupling members 52 extending outward and beyond edges 58 and 60 from one or both sides 32 and 34 of the first section, and one or more cooperating female receiving spaces 56 on one or both sides 46 and 48 of the second section. The male coupling members 52 are biasable for releasable engagement with the female receiving spaces 56.

Additionally, the fastening system may include a web 50 secured to and extending across the inner surface 22 of the first section 18 from the first side 32 to the second side 34. The male coupling members 52 extend from opposed sides of the web 50 at both the first and the second sides 32 and 34 beyond edges 58 and 60, respectively. Each male coupling member 52 may include a lateral protrusion 54 extending outwardly therefrom. The male coupling members are each dimensioned so as to permit the male coupling member to pass through an opening 16 of the fencing 12. The male coupling members 52 may be made from a resilient material that allows the male coupling members to be laterally biasable. It is to be understood that any number of male coupling members 52 may extend from either the first or second sides 32 or 34 or both sides, and that the male coupling members need not to include a web 50 but can be attached to the first and second sides by any known method or can be integrally molded.

Figure 3:
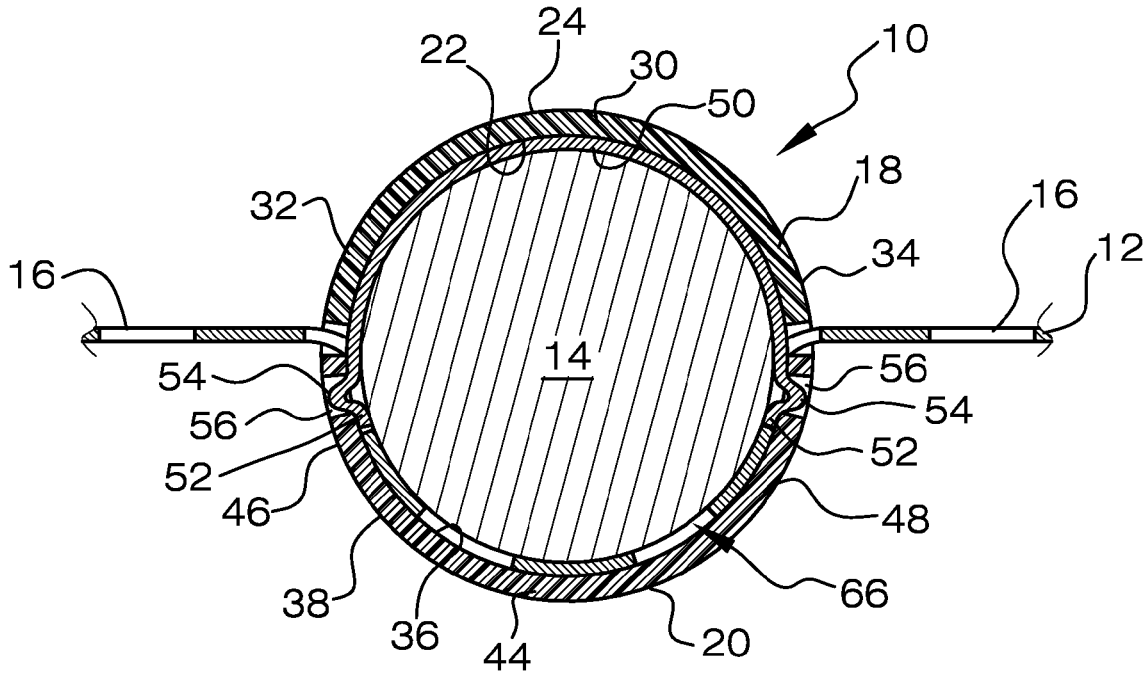
FIG. 3 is a cross sectional view of a fence fastener taken on line 3-3 in FIG. 1, showing the first and the second sections coupled together securing the fencing to the fence post.

When the first and second sections 18 and 20 are detachably coupled together, as shown in FIG. 3, the male coupling members 52 are releasably biased into engagement with corresponding female receiving spaces 56 with the inner surfaces 22 and 36 facing one another such that the inner surfaces define an axial passage 66 that extends from the first ends 26, 40 to the second ends 28, 42 through which the fence post 14 extends. The protrusions 54 of the male coupling members 52 frictionally engages into the female receiving spaces 56, in a releasable snap-fit fashion. The female receiving spaces 56 can be through holes or recesses that are formed into the first or second sides 46 or 48 or both sides of the second section 20. Each female receiving space 56 being of a size and shape corresponding to a protrusion 54 of a male coupling member 52. It should be understood that any number of female receiving spaces 56 can be form on the second section 20.

Figure 5:
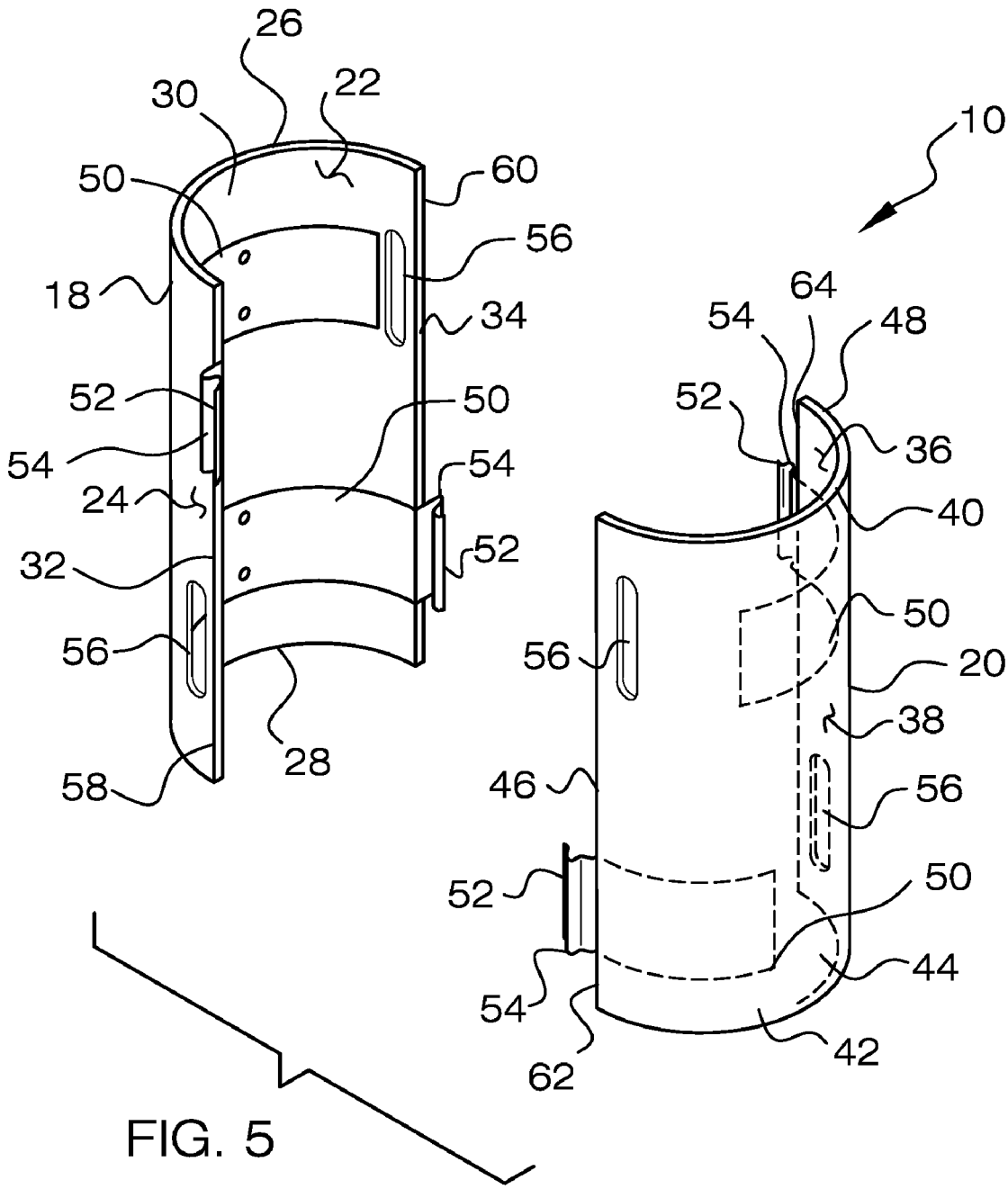
FIG. 5 is a perspective exploded view of an alternate embodiment of a fence fastener in accordance with the principles of the present invention.

In an alternate embodiment, as shown in FIG. 5, the first section 18 has at least one male coupling member 52 extending from either the first side 32 or the second side 34, and at least one female receiving space 56 on either the first side 32 or the second side 34. The second section 20 has at least one male coupling member 52 extending from either the first side 46 or the second side 48, and at least one female receiving space 56 on either the first side 46 or the second side 48.

Figure 4:
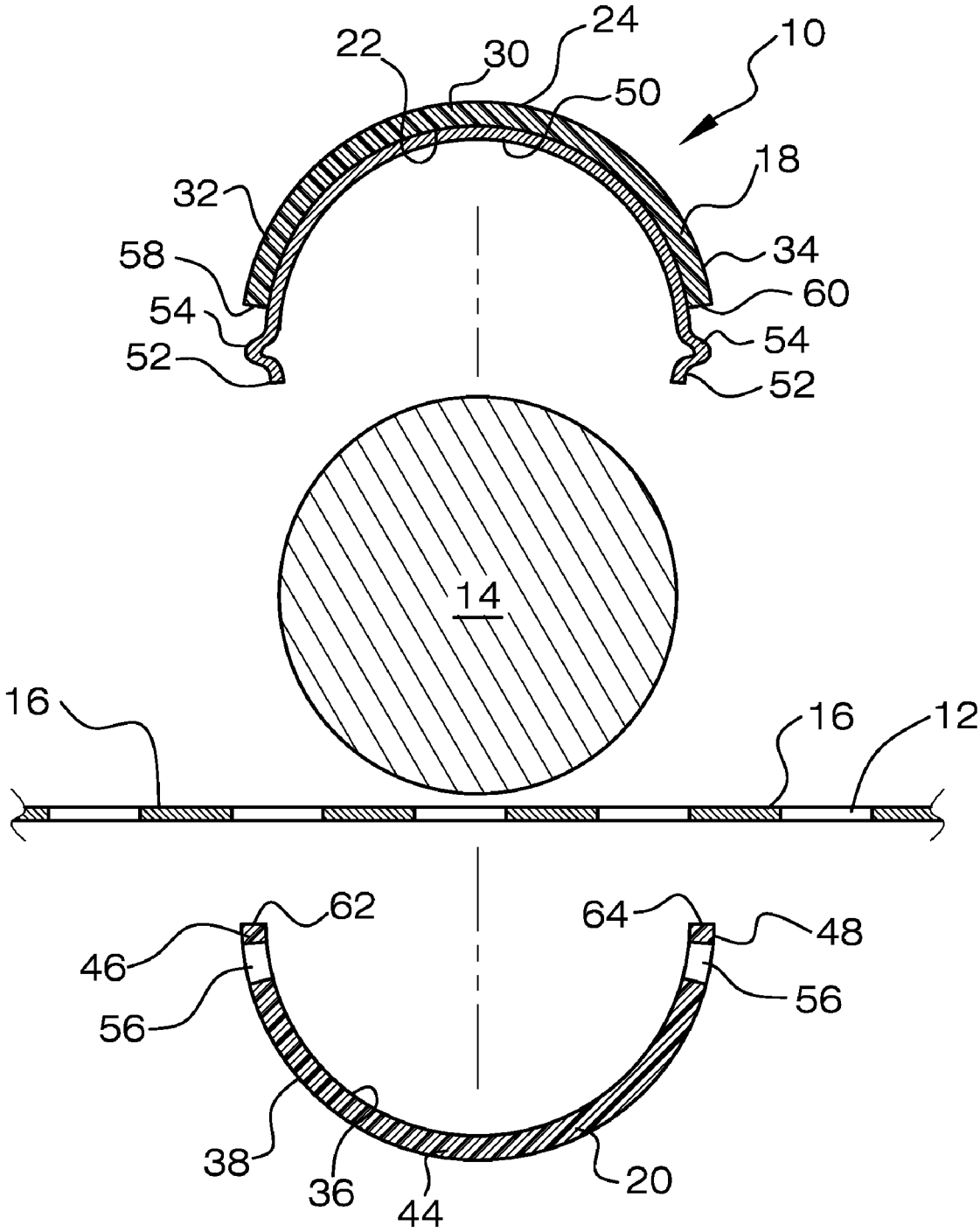
FIG. 4 is an exploded view of the elements shown in FIG. 3.

In use, as shown in FIGS. 1, 3 and 4, the first section 18 of the fence fastener 10 is placed on one side of the fencing 12 and the fence post 14 and the second section 20 is placed on the opposite side of the fencing and the fence post. Then the sections 18 and 20 are brought together into releasable engagement with one another, with the male coupling members 52 passing through the openings 16 of the fencing. The male coupling members 52 are then biased in a lateral direction inwardly and the protrusions 54 of the male members are received by the female receiving spaces 56, thereby coupling the first and second sections 18 and 20 together and securing the fencing 12 to the fence post 14. As shown, the fencing 12 and the fence post 14 are clamped together by and between the first and second sections 18 and 20 of the fence fastener 10 with the fence post extending through the axial passage 66.

A number of embodiments of the present invention have been described. Nevertheless, it will be understood that various modifications may be made without departing from the spirit and scope of the invention. Accordingly, other embodiments are within the scope of the following claims.

We claim:

1. A fence and fence fastener assembly, comprising:

a section of open mesh fencing;

a fence post;

said section of fencing extending across said fence post;

a fence fastener including first and second separable and complementary semi-circular sections; each section having first and second sides extending from a middle web portion, each of said first and second sides terminating at an edge; said fence fastener further including one or more male coupling members extending outwardly from each of said first and said second sides beyond said edges thereof of said first section, each of said one or more male coupling members including a protrusion; said second section having one or more female receiving spaces on each of said first and said second sides of said second section at a position inwardly from said edges thereof in a direction towards said middle web portion; each of said one or more male coupling members being biasable such that said protrusion extends through said section of open mesh fencing and is frictionally engagable into said one or more female receiving spaces in a releasable, snap-fit engagement;

said first and said second sections positioned on opposite sides of said fence post and said section of fencing and secured together with said edges of said first and said second sides of said first section opposed to said edges of said first and said second sides of said first section at a spaced distance forming a gap therebetween and clamping said fence post and said section of fencing with said fence post and said section of fencing disposed within an axial passage formed by an inner surface of each of said first and said second sections and with said section of fencing extending said gap.

2. The assembly of claim 1, wherein each of said female receiving spaces a through holes extending laterally through said first and said second sides, respectively, of said second section.

3. The assembly of claim 2, wherein each of said one or more male coupling members being laterally biasable.

4. The assembly of claim 1, wherein said axial passage extends between first and second ends of each of said first and said second sections.

* * * * *